US005937454A

United States Patent [19]

Drew

[11] Patent Number: 5,937,454

[45] Date of Patent: Aug. 17, 1999

[54] BATHING CHAIR

[76] Inventor: Kathleen Drew, 1453 Camelot Ave., Corona, Calif. 91720

[21] Appl. No.: 09/196,076

[22] Filed: Nov. 18, 1998

[51] Int. Cl.[6] ..... A47K 3/12

[52] U.S. Cl. ..... 4/565.1; 4/566.1; 297/423.3; 297/344.18

[58] Field of Search ..... 4/560.1–566.1; 297/291, 297, 299, 344.18, 423.3

[56] References Cited

U.S. PATENT DOCUMENTS

| | | | |
|---|---|---|---|
| 424,730 | 4/1890 | Schoonmaker . | |
| 431,004 | 6/1890 | Nason | 297/297 |
| 1,892,274 | 12/1932 | Henschen | 4/561.1 |
| 2,680,855 | 6/1954 | Robinson | 4/562.1 |
| 3,290,090 | 12/1966 | Ford | 297/118 |
| 3,855,646 | 12/1974 | Glickman | 4/185 S |
| 4,013,316 | 3/1977 | Cropper | 4/564.1 |
| 4,128,904 | 12/1978 | Ekman et al. | 4/560.1 |
| 4,338,691 | 7/1982 | Gaffney | 4/562.1 |
| 4,768,239 | 9/1988 | Pauley | 4/564.1 |
| 5,103,509 | 4/1992 | Richards | 4/564.1 |
| 5,157,797 | 10/1992 | Forwick | 4/566.1 |
| 5,335,377 | 8/1994 | Masyada | 4/578.1 |
| 5,402,541 | 4/1995 | Schmidt | 4/566.1 |
| 5,580,127 | 12/1996 | Piretti | 297/291 |

FOREIGN PATENT DOCUMENTS

| | | | |
|---|---|---|---|
| 1035959 | 9/1953 | France | 4/563.1 |
| 2845109 | 4/1980 | Germany | 4/560.1 |
| 2017014 | 10/1979 | United Kingdom | 4/561.1 |

*Primary Examiner*—Charles R. Eloshway
*Attorney, Agent, or Firm*—Goldstein & Canino

[57] ABSTRACT

A bathtub chair, for mounting in a bathtub having a bathtub bottom and bathtub sides extending upward from the bathtub bottom, comprising a seat cushion and a lowering mechanism. The lowering mechanism comprises a plurality of telescopic legs which extend downward from a hollow seat frame to the bathtub bottom. The chair is lowerable so that the seat rests flush against the bathtub bottom. The seat comprises a mid section attached above the plurality of telescopic legs, and upper and lower sections. The upper and lower sections are coupled to the mid section so that they normally extend perpendicular to the mid section when the chair is raised, but then flex to conform to the bathtub when the mid section is lowered against the bathtub bottom.

8 Claims, 3 Drawing Sheets

BATHING CHAIR

BACKGROUND OF THE INVENTION

The invention relates to a bathing chair. more particularly, the invention relates to a chair which is mounted within a bathtub, the chair is lowerable to allow a person seated in the chair to be lowered into the tub.

Bathing is one of the everyday difficulties facing a large percentage of persons suffering from disabilities. Most people who suffer from disabilities face considerable difficulty when getting into and out of the bathtub. In such circumstances, the inherent dangers in and around the bathing area are increased because of the person's infirmity.

Often the only option available for the disabled person is to take a shower. Therefore, the known therapeutic value of a bath cannot be taken advantage of by these people.

Several others have proposed chairs which are intended for allowing a person to sit while showering. Others have proposed complicated, crane-like devices for hoisting and lowering a person into a bathtub.

While these units may be suitable for the particular purpose employed, or for general use, they would not be as suitable for the purposes of the present invention as disclosed hereafter.

SUMMARY OF THE INVENTION

It is an object of the invention to produce a bathtub chair which allows a person suffering from a disability to safely and easily enter the bathtub.

It is another object of the invention to provide a bathtub chair that is portable, so that it may be easily transported.

It is yet another object of the invention to provide a bathtub chair which allows a person seated in the chair to lower directly into the bathtub, and then rise out of the bathtub after bathing. Accordingly, the chair is placed within the confines of the bathtub. The chair has a hydraulic lowering mechanism for lowering directly downward until the person is seated near the bottom of the bathtub.

The invention is a bathtub chair, for mounting in a bathtub from the bathtub bottom, comprising a seat and a lowering mechanism. The lowering mechanism comprises a plurality of legs which extend to the bathtub bottom and support the seat. The chair is lowerable so that the seat rests flush against the bathtub bottom. The seat comprises a mid section attached above the legs, and upper and lower sections. The upper and lower sections are attached to the mid section such that they normally extend perpendicular to the mid section when the chair is raised, but then flex to conform to the bathtub when the mid section is lowered against the bathtub bottom.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
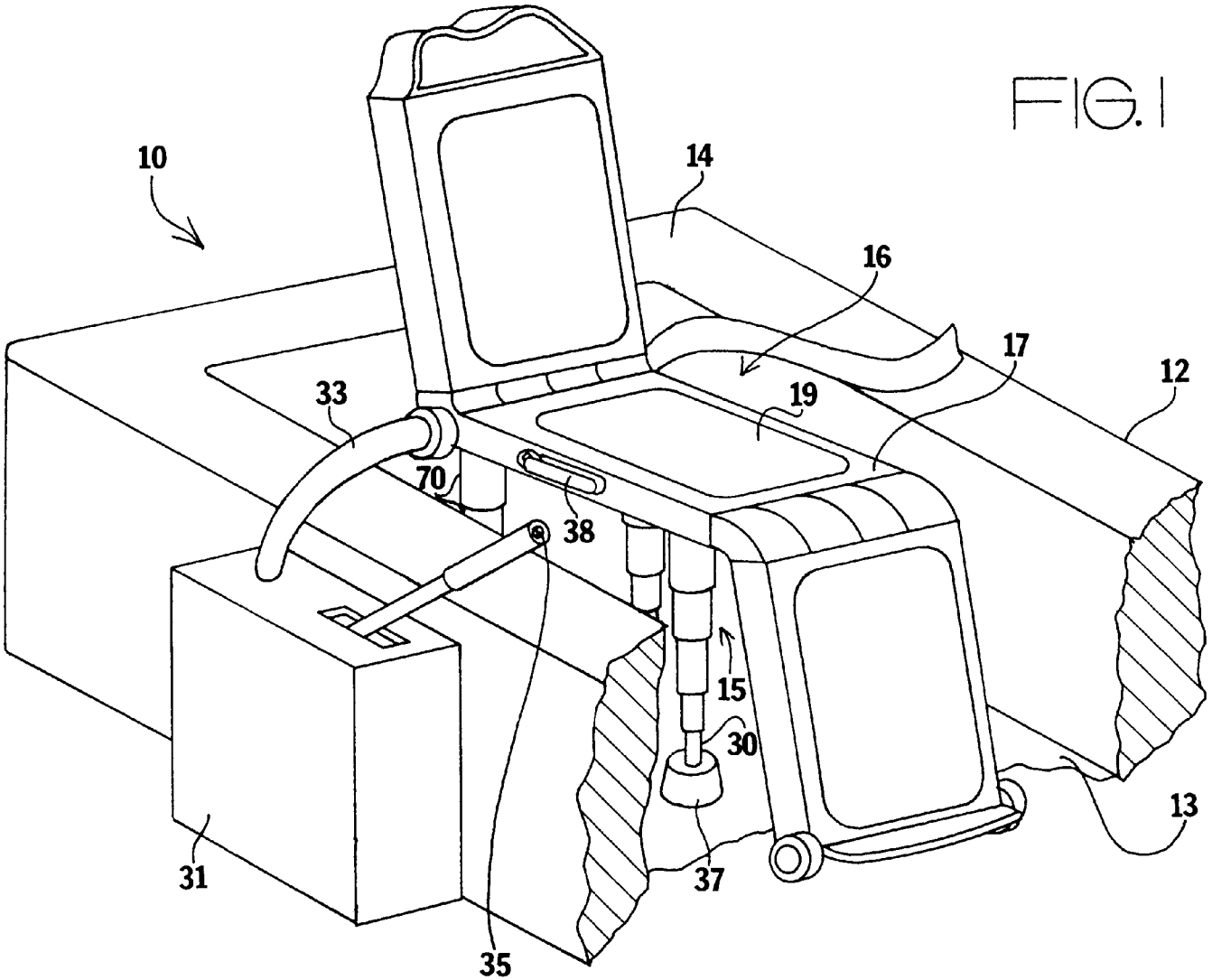
FIG. 1 is a diagrammatic perspective view, illustrating the bathtub chair mounted within a bathtub, the bathtub chair raised above the bathtub.

FIG. 1 illustrates a bathtub chair 10, mounted within a bathtub 12 having a bottom 13, and side walls 14 extending upward from the bottom 13. The side walls 14 and bottom 13 are capable of containing a quantity of water. The bathtub chair 10 is located fully between all the side walls 14.

The bathtub chair 10 comprises a lowering mechanism 15 and a seat 16 mounted upon the lowering mechanism 15. The lowering mechanism 15 comprises a hollow seat frame 17 with a plurality of telescopic legs 30 extending downward therefrom to the bottom 13 of the bathtub 12.

The legs 30 are constructed from a plurality of telescopic segments 70 that collapse into each other to allow the seat 16 to drop to the bottom 13 of the bathtub 12. Each telescopic segment 70 is cylindrical in shape and is hollow in its interior portion. The legs 30 are provided with suction cups 37 that secure the bathtub chair 10 to the bottom 13 of the bathtub 12.

A hydraulic pressure source 31 is connected to the seat frame 17 of the lowering mechanism 15 for selectively supplying pressurized fluid to the legs 30. The hollow interior of the telescopic segments 70 of the legs 30 receive the pressurized fluid for raising the chair 10 and relieve the pressurized fluid for lowering the chair 10. The hydraulic pressure source 31 is connected to the seat frame 17 with a hydraulic line 33. The specific design of the hydraulic pressure source 31 and telescopic legs 30 is well known, and thus is not detailed herein.

The hydraulic pressure source 31 is structured as a portable briefcase to allow easy transportation. It is possible to disassemble the hydraulic line 33 from the hydraulic pressure source 31 for compact transportation.

A lowering and raising control 35 is located atop the hydraulic pressure source 31 which is placed adjacent to the bathtub 12 for providing easy access to a person seated in the chair 10 or a person outside of the bathtub 12. The lowering and raising control 35 is connected directly to the hydraulic pressure source 31.

Figure 2:
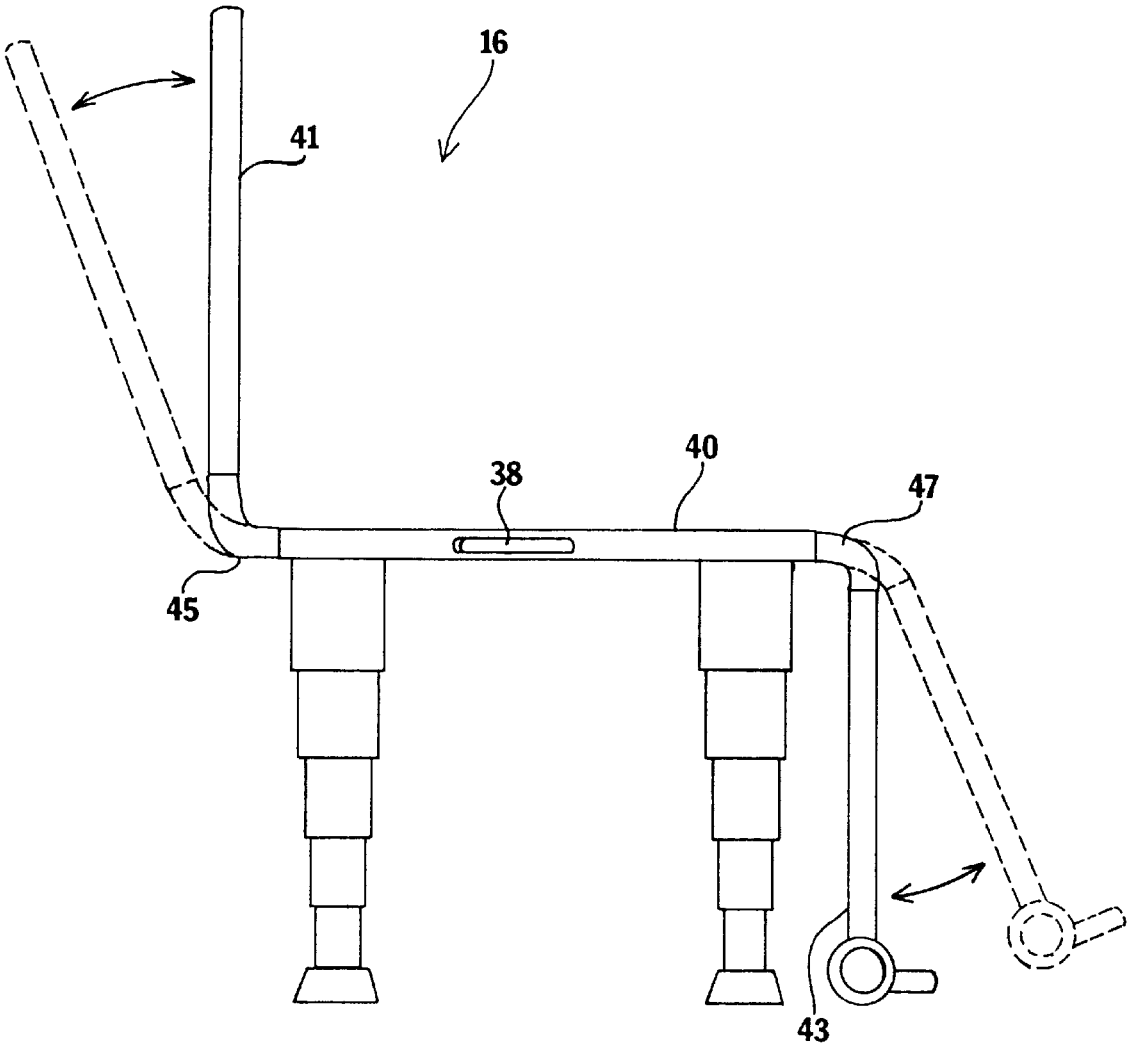
FIG. 2 is a side elevational view, illustrating the hinged multi-part construction of the seat.

FIG. 2 is a side elevational view, detailing the seat 16. The seat 16 comprises a mid section 40, an upper section 41, and a lower section 43. The upper section 41 is attached to the mid section 40 with an upper elastic coupling 45, and the lower section 43 is attached to the mid section 40 with a lower elastic coupling 47. The couplings 45 and 47 are preferably made from an elastic substance, such as rubber, to allow easy biasing to a position substantially perpendicular from the mid section 40.

When in an equilibrium position, the upper section 41 extends vertically upward from the mid section 40 and the lower section 43 extends vertically downward from the mid section 40. The upper section 41 provides back support to the person while seated upon the mid section 40.

The bathtub chair 10 is provided with a lever 38 on the right side of the mid section 40. Upon engaging the lever 38, the user is able to lower the upper section 41. According to the invention, it is preferable to lower the upper section 41 once the bathtub chair 10 has been fully lowered to the bottom 13 of the bathtub 12.

As shown in FIG. 1, the mid section 40 of the seat 16 has a cushion 19 housed within a frame 17 that is supported directly by the plurality of legs 30. The cushion 19 ensures that the person using the bathtub chair 10 is comfortably seated.

Figure 3:
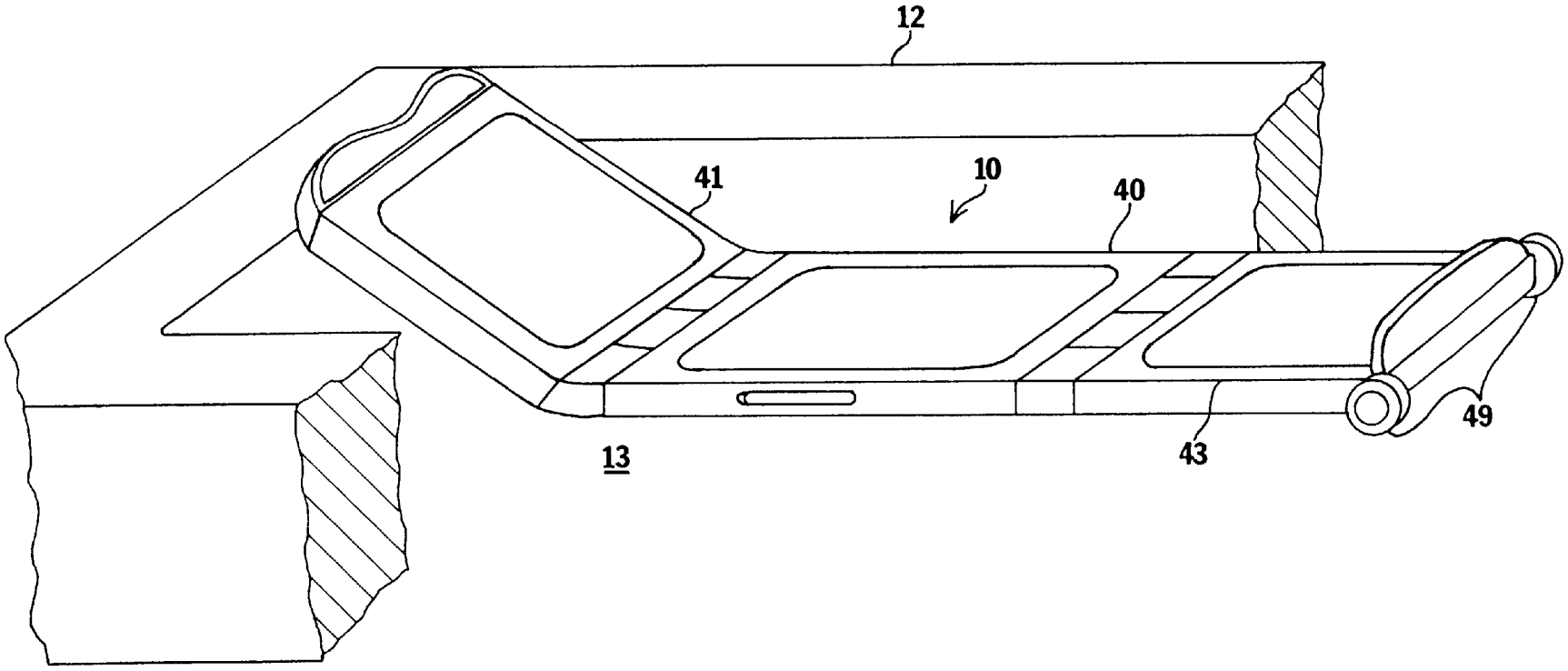
FIG. 3 is a diagrammatic perspective view, illustrating the bathtub chair fully lowered into the bathtub.

Referring to FIG. 3, the bathtub chair 10 has been lowered, by activating the lowering mechanism 15 until the mid section 40 of the seat cushion is flush against the bathtub bottom 13.

The lower section 43 is provided with a pair of rollers or wheels 49. As the chair 10 is lowered, the wheels 49 move on the bottom 13 of the bathtub 12 away from the mid section 40. The downward movement of the chair 10 causes the wheels 49 of the lower section 43 to flex outward, and the seat 10 extends nearly horizontally once the mid section 40 is flush against the bottom 13.

The upper coupling 45 is upward biased to provide support to the upper section 41 while a person is seated, but a person may lie backward on the bathtub seat 10 by engaging the lever 38 and pushing the upper section 41 into a reclining position with their body weight. The upward biasing of the upper coupling 45 provides assistance to the person when they decide to sit upward.

Preferably, the bathtub chair 10 should be lowered until the mid section 40 is flush against the bathtub bottom before filling the bathtub with water. Additionally, the bathtub 12 should be fully drained before raising the bathtub chair 10. In this way, the legs 30 are well protected against water leaking into the hydraulic system 31, and the bath water is protected from contamination by the hydraulic fluid in the hydraulic system 31.

To ensure easy transportation, the bathtub chair 10 is made from a light-weight but sturdy material, such as stainless steel alloy or the like.

In conclusion, herein is presented a bathtub chair which is temporarily mounted within a bathtub, and allows a disabled bather to be easily and safely lowered into the bathtub for bathing, and then raised above the bathtub after bathing.

What is claimed is:

1. A bathtub chair, for mounting in a bathtub having a bottom and side walls extending upward from the bottom, comprising:

a seat having a mid section, an upper section pivotally attached to said mid section with an upper elastic coupling for allowing said upper section to assume a generally horizontal position, and a lower section pivotally attached to said mid section with a lower elastic coupling, wherein said mid section comprises a seat frame which has a seat cushion mounted therein; and a plurality of legs extending downward from the seat frame for contacting the bottom of the bathtub and selectively raising the seat above the side walls and lowering the seat to allow a person to be seated within the bathtub, said seat and said legs being located fully between the side walls of the bathtub in use wherein, as said seat is moved from the raised to the lowered position, the lower end of said lower section contacts the bottom of the tub and moves away from said midsection, so that said lower section pivots about said lower elastic element and moves from a generally vertical raised position to a generally horizontal lowered position adjacent the bottom of the tub.

2. The bathtub chair as recited in claim 1, wherein the upper elastic coupling is upward biased so that the upper section of the seat extends substantially perpendicularly upward from the mid section in its equilibrium, said upper elastic coupling allowing the upper section to become substantially parallel to the bottom of the bathtub when the upper section is lowered.

3. The bathtub chair as recited in claim 1, wherein the lower section comprises a pair of wheels for enabling the lower section to pivot when the seat is lowered.

4. The bathtub chair as recited in claim 3, wherein the lower elastic coupling is downward biased so that the lower section extends substantially perpendicularly downward from the mid section in its raised position.

5. The bathtub chair as recited in claim 1, wherein the seat frame is connected to a hydraulic pressure source that is capable of supplying pressurized fluid thereto, wherein the seat frame supplies the Pressurized fluid to the plurality of legs for selectively raising and lowering the seat.

6. The bathtub chair as recited in claim 5, wherein each of the plurality of legs is constructed from a plurality of telescopic segments having a hollow interior to receive the pressurized fluid from the hydraulic pressure source.

7. The bathtub chair as recited in claim 1, wherein each of the plurality of legs is constructed from a plurality of telescopic segments having a hollow interior.

8. The bathtub chair as recited in claim 7, wherein the plurality of legs are provided with suction cups for securing the bathtub chair to the bottom of the bathtub.

* * * * *